United States Patent [19]

Melis et al.

[11] Patent Number: 4,649,260

[45] Date of Patent: Mar. 10, 1987

[54] LIGHTER FOR STOVE, OPEN HEARTH AND SIMILAR

[75] Inventors: Florentinus Melis, Westmalle; Jan Verbergt, Zoersel; Willy Van Rooy, Malle, all of Belgium

[73] Assignee: Coal-O-Matic PVBA, Belgium

[21] Appl. No.: 838,398

[22] Filed: Mar. 6, 1986

Related U.S. Application Data

[63] Continuation of Ser. No. 494,333, Mar. 16, 1983, abandoned, which is a continuation-in-part of Ser. No. 188,907, Sep. 19, 1980, abandoned.

[51] Int. Cl.[4] ..... F23Q 7/22

[52] U.S. Cl. ..... 219/267; 126/25 B; 126/152 R; 219/270; 219/264

[58] Field of Search ..... 219/303, 270, 267, 261, 219/264, 265; 126/25 B, 152 R

[56] References Cited

U.S. PATENT DOCUMENTS

| | | | |
|---|---|---|---|
| 2,396,591 | 3/1946 | Melniczak | 219/267 |
| 2,484,544 | 10/1949 | Bennett et al. | 219/267 |
| 2,540,278 | 2/1951 | Molotzak | 126/25 B |
| 2,808,495 | 10/1957 | Cole | 219/260 |
| 3,156,199 | 11/1964 | Buckle | 219/267 |
| 3,366,102 | 1/1968 | Mathis | 219/267 |
| 3,521,213 | 7/1970 | Hardy | 219/270 |

FOREIGN PATENT DOCUMENTS

| | | | |
|---|---|---|---|
| 56171 | 4/1944 | Netherlands | 219/270 |
| 210127 | 1/1924 | United Kingdom . | |
| 537190 | 6/1941 | United Kingdom . | |
| 690667 | 4/1953 | United Kingdom | 219/267 |
| 895931 | 5/1962 | United Kingdom . | |
| 1080158 | 8/1967 | United Kingdom . | |

OTHER PUBLICATIONS

McGraw-Hill Dictionary of Scientific & Technical Terms—1974, p. 317.

*Primary Examiner*—Carroll B. Dority, Jr.
*Attorney, Agent, or Firm*—Wood, Dalton, Phillips, Mason & Rowe

[57] ABSTRACT

There is described a lighter for ovens, open hearths and similar, which comprises a holder the one end of which on the one hand is extended with a support from fire-proof non-conducting material wherein an incandescent resistor is supported, which resistor may be engaged directly with the solid fuel to be lighted, such as wood or coal, and the other end of which on the other hand, is provided with a handle which is connectable to an electric power source.

7 Claims, 8 Drawing Figures

Fig. 1
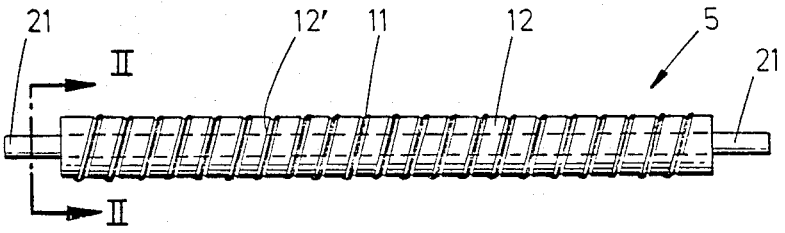
Fig. 2
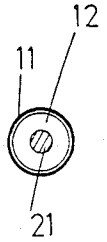
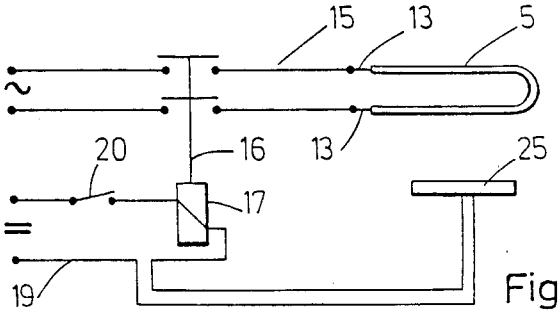
Fig. 6

LIGHTER FOR STOVE, OPEN HEARTH AND SIMILAR

This application is a continuation, of application Ser. No. 494,333, filed Mar. 16, 1983, and now abandoned.

The latter application is a continuation-in-part of application Ser. No. 188,907, filed Sept. 19, 1980, now abandoned of Florentinus Melis et al entitled "Grate for Combustion Apparatus".

DESCRIPTION

This invention relates to an ignition device for combustion apparatus for solid fuels, more particularly open fires, wood stoves, coal stoves, barbecues, baking ovens, coal- or wood-fired steam boilers, for instance for central heating, built-in furnaces with hot-water tank, etc.

The laying of a fire in combustion apparatus which are fired with solid fuels such as coal, wood or charcoal, is generally complex and time-consuming, as well as requiring in most cases some handiness not be to underrated. There is moreover a danger of smoke and/or dust forming during the lighting.

When further for some reason or other, the fire is put out when adding wood or coal pieces, after the kindling wood has been lighted, it is first required to remove all fuel from the combustion apparatus before a new attempt at fire lighting can be made and it is necessary to use a fresh amount of kindling wood or substitute thereof.

The invention has mainly for object to obviate said various drawbacks and to provide an ignition device which allows lighting a fire in a combustion apparatus which is fired with a solid fuel, substantially in the same way as in a combustion apparatus for liquid or fuel.

For this purpose the ignition device comprises an ignition element having a substantially tube-like support from refractory insulating material through which extends axially a stiffening rod, an incandescent resistance being helicoidally wound around the support and being uncovered by a refractory insulating coating, so as to be directly in contact with said solid fuels.

The invention further relates to a grate which is fitted with such an ignition element.

The invention has also for object to provide a very simple and useful portable apparatus which allows to light any kind of solid fuel, in a minimum time period and without requiring some very inflammable material such as oil, fine wood or paraffin.

For this purpose the ignition device according to this particular embodiment of the invention comprise a portable ignition element having at one end a substantially tube-like support from refractory insulating material through which extends axially a stiffening rod, an incandescent resistance being helicoidally wound around the support and being uncovered by a fire-proof casing, so as to be directly in contact with said solid fuels, said element being provided at the other end with a handle which is connectable to an electric power source.

Other details and features of the invention will stand out from the following description, given by way of non limitative examples and with reference to the accompanying drawings, in which :

FIG. 1 is a lateral view of an ignition element according to the invention.

FIG. 2 is a section view along line II—II in FIG. 1.

FIG. 6 is a diagrammatic showing of the electric circuitry for the ignition elements.

In the various figures, the same reference numerals pertain to the same or similar elements.

Figure 3:
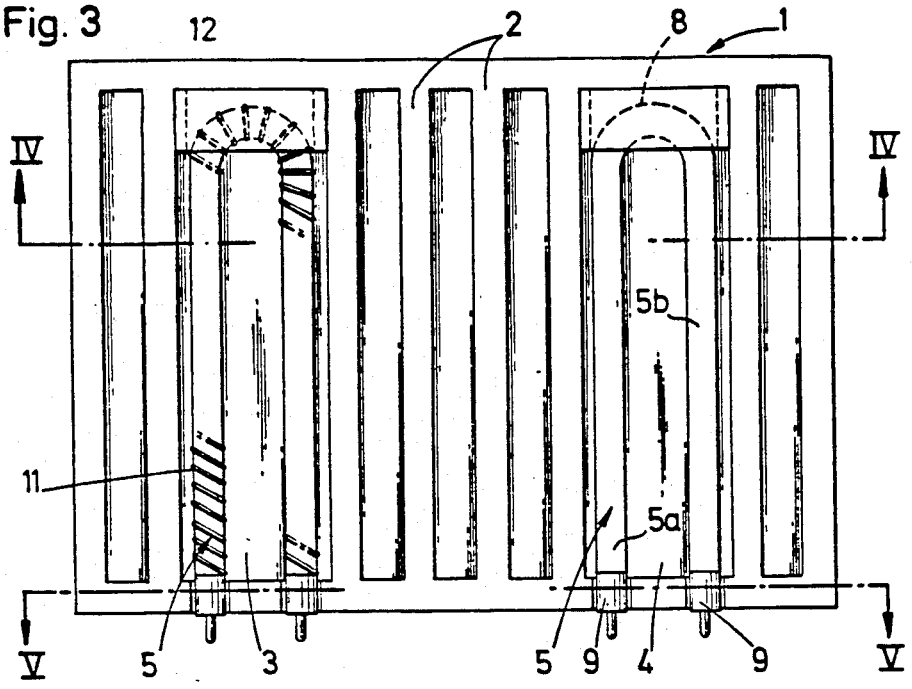
FIG. 3 is a top view of a rectangular grate according to the invention which is fitted with two discrete ignition elements.

In FIGS. 1 and 2 has been shown an ignition element 5 comprised of a tube-like support 12 from refractory insulating material through which extends an iron stiffening rod 21, which will bear on a grate not shown in these figures.

Over the cylinder-like outer surface of said tube 12 is wound an incandescent resistance wire 11 with a diameter of f.i. about 2 mm, which is possibly protected by a corrosion-resistant layer, such as ceramic lacquer.

The resistance 11 is in this embodiment comprised of constantan.

The outer surface of the support 2 can be provided with a helicoidal groove 12' wherein the incandescent resistance 11 is freely wound around the support.

Figure 4:
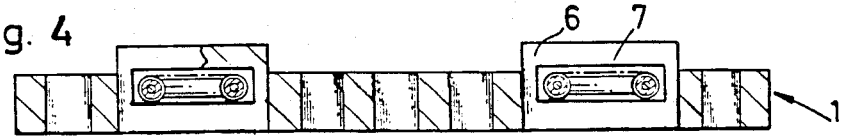
FIG. 4 is a section view along line IV—IV in FIG. 3.
Figure 5:
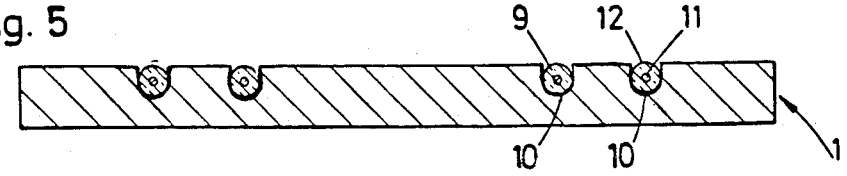
FIG. 5 is a section view along line V—V in FIG. 3.

In FIGS. 3 to 5 has been shown a rectangular grate 1 from cast iron, which has a series of bars 2 in parallel relationship.

Between said bars are provided according to the invention, two spaces 3 and 4 for a U-shaped ignition element 5 the legs 5*a* and 5*b* of which extend some distance away in parallel relationship with said bars 2 and on which consequently fuel not shown can bear in the sme way as on the bars 2.

Said ignition elements are preferably removably mounted in said spaces 3 and 4.

For this purpose said grate 1 is provided at the one end of said holders with a recess 7 covered by a bridge 6 and wherein is slidingly fitted the bent end 8 of said ignition element 5.

The free ends of legs 5*a* and 5*b* from said ignition element 5 are provided with a cylinder-like plug 9 which bears in a groove 10.

The vertical depth of recess 7 and grooves 10 corresponds substantially to the thickness of said ignition element 5, with the result that the top element surface lies substantially in the top plane of grate 1.

Said ignition elements 5 thus bear but with the ends thereof on the grate, with the result that the relative contact area between said grate and ignition element is limited and consequently a too-strong heating of said ignition element is prevented during the combustion of the solid fuel bearing thereon, by means of the combustion air which flows upwards through the grate. The grate thus can be secured by any conventional means readily available and known to those skilled in the art.

To enhance the lighting speed, use is preferably made according to the invention, of a fan not shown, which increases the air suction through the grate and thus limits the glow time of said element 5.

Said ignition element 5 may be an element as shown in FIGS. 1 and 2.

The ends of said resistance wire 11 are formed by relatively thick pins 13 which extend through plug 9, preferably made from ceramic or porcelain, to outside the support 12.

Said resistance wire is preferably comprised of constantan, that is an alloy which is particularly suitable for ignition wires.

By means of said pins 13, the resistance wire 11 is connected into an electric circuit 15 which thus allows to pass an electric current through said resistance wire 11 to heat same and cause the wire to glow.

In said circuit 15 is connected as shown in FIG. 6, an electro-magnetically operated switch 16 the coil 17 of which may be energized through a control knob 20 which is connected in the control circuit 19 for said coil.

In said control circuit may possibly be provided a thermostat 25 which can adjust the temperature of said ignition element or cut-off same when the combustion of the solid fuel arranged on said grate has started.

The supply to resistance wire 11 may for example occur with conventional A.C., while the control circuit of the electro-magnetic switch 16 may be energized with low-voltage D.C.

This does comprise an electric circuit which is known per se.

Finally it may be of great importance according to the invention, to provide in said electric circuit a time switch (not shown), for automatically cuttingoff the supply to the resistance wire.

Consequently, the lighting time or that time interval during which said element 5 is caused to glow, may be determined according to the fuel which is being used.

It has for instance been determined that blocks from beech wood with a mean diamter of 20 cm, are ignited after 1 minute 30 seconds at the most, while the hardest coal kind, with a size of 12/22 mm, requires a maximum duration of 4 minutes.

Said lighting time may generally be limited to a shorter time interval by providing for an excess compbustion air flowing through the grate during said lighting.

The above-defined lighting times always pertain to an inflammation with a shortage of oxygen.

Care should further be taken that sufficient contact is present during the lighting between the ignition elements and the solid fuel.

Figure 7:
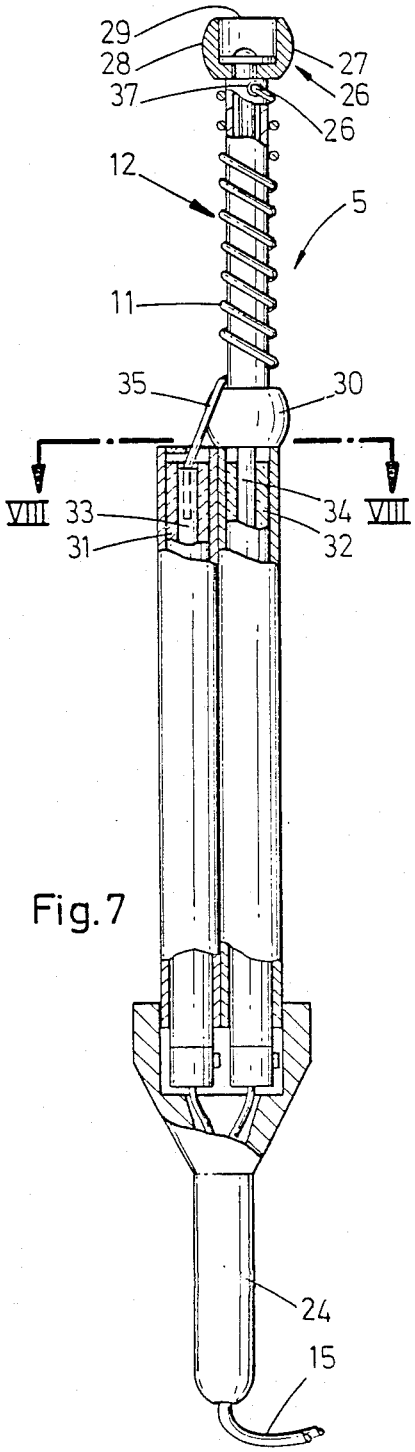
FIG. 7 shows an ignition element in another embodiment of the invention.
Figure 8:
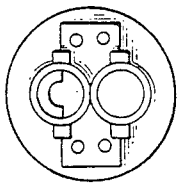
FIG. 8 is a section view along line VIII—VIII in FIG. 7.

In FIGS. 7 and 8 has been represented a particular embodiment of the invention, which is in fact a portable lighter for stoves, open hearths and similar, which is completely loose and independent from the structure of the stove or open hearth for example. It is thus a matter of a lighter which is simply removed from the stove or open hearth, after lighting the fuel.

Said lighter has the general shape of a poker and comprises notably a holder the one end of which is extended with a support 12 from a fire-proof non-conducting material, whereon an incandescent resistance 11 is fastened, and the other end of which is provided with a handle 24 which is connected or connectable through a cable 15 to an electric power source, not shown, which source is preferably a low-voltage source.

According to the invention, the incandescent resistance 11 is possibly protected with a thin corrosion-proof layer, but it is not arranged inside a fire-proof casing or similar, in such a way that said resistance can contact directly the solid fuel to be lighted.

The support 12 is formed by a tube-like rod from porcelain, around which the incandescent resistance 11 in the shape of a resistance wire, is wound.

The free end of said rod 12 is provided with a rounded protecting part 26 which projects relative to the incandescent resistance 11 and which can be slipped between the solid fuel when lighting same.

Said protecting part is comprised of a procelain cap which is provided with a projecting cylinder-like flange 27. Said flange extends in substantially parallel relationship with the axis of said rod 12 and has an outer diameter which is larger than the rod diameter.

The outer wall 28 of said flange 27 is substantially convex-bevelled to form a somewhat sharp edge 29 on that end removed from said rod 12, of the cap 26, in such a way that said cap 26 may thus be slipped without too much of a resistance through a wood or coal pile when lighting same.

About that end of rod 12 removed from the end the cap 26 is fastened on, is provided an insulating closure part 30 which bears against the holder and which also projects in the same way as cap 26, relative to said incandescent resistnace which lies between said part 30 and cap 26.

Said holder comprises two insulating tubes from fire-proof material, which extend from said handle 24 up to said rod 12, and which each enclose a conductor 33 and 34 respectively. Said conductors 33, 34 have a resistance which is substantially smaller than the resistance of the incandescent resistance 11, in such a way that substantially no heating of said conductors 33, 34 does occur during the lighter operation.

The one free end 35 of said incandescent resistance 11 is connected to conductor 33, while the other end 36 thereof is connected to conductor 34.

Said rod 12 which is thus formed by a hollow tube, connects to a sleeve 32, while the conductor 34 thereof extends inside the rod 2 up to adjacent the free end thereof. In said free end is provided a passageway 37 through which the end 36 of said incandescent resistance is connected to conductor 34.

That end of conductors 33,34 lying on the side of handle 24, connects to said electric cable 15.

What we claim is:

1. In an improved combustion apparatus for burning solid fuels, said apparatus having a grate including spaced portions defining a space therebetween and an upper surface, the improvement comprising:

at least one electric ignition element having a tube-like support of refractory insulating material having a helical outer groove, and a resistance heater wire element within said groove and having at least a portion thereof, carried by the support, free of any fire-proof insulative casing and disposed to be spaced from said grate in said space, said support having opposite ends, cylinder-like insulative support means mounting the opposite ends of the support on the grate with the portion of the resistance element carried by the support juxtaposed to said grate upper surface to be directly contacted by solid fuels on said upper surface of the grate whereby said fuel may be supported partially by said grate and partially directly by said heater wire element while maintaining the heater wire element spaced from the grate to effectively maximize the fuel igniting temperature thereof, said heater wire element being electrically insulated from the grate by said insulative support means and said heater wire element including electrically conductive means extending through said cylinder-like support means.

2. The improved combustion apparatus according to claim 1, wherein a stiffening rod extends coaxially in the support.

3. The improved combustion apparatus according to claim 1, wherein the resistance is comprised of constantan.

4. The improved combustin apparatus according to claim 1, wherein the resistance is connected in an electric circuit, in which circuit a thermostat is also connected.

5. The improved combustion apparatus according to claim 4, wherein the resistance is energized with a low voltage in said electric circuit.

6. The improved combustion apparatus according to claims 4 or 5, wherein the resistance is connected in an electric circuit for automatically cutting-off the electrical supply to said element.

7. The improved combustion apparatus according to claim 1, wherein said support means comprises means for removably mounting the ignition element to the grate.

* * * * *